US005123476A

United States Patent [19]

Fealey

[11] Patent Number: 5,123,476

[45] Date of Patent: Jun. 23, 1992

[54] CONTINUOUS METAL TUBE CASTING METHOD AND APPARATUS USING INNER SOLENOID COIL

[75] Inventor: James A. Fealey, Albany, N.Y.

[73] Assignee: Showa Electric Wire and Cable Co., Ltd., Japan

[21] Appl. No.: 569,400

[22] Filed: Aug. 17, 1990

[51] Int. Cl.[5] ..... B22D 27/02

[52] U.S. Cl. ..... 164/466; 164/502

[58] Field of Search ..... 164/466, 467, 502, 503

[56] References Cited

U.S. PATENT DOCUMENTS

| | | | |
|---|---|---|---|
| 4,126,175 | 11/1978 | Getselev | 164/503 |
| 4,414,285 | 11/1983 | Lowry et al. | 164/467 |
| 4,452,297 | 6/1984 | Ungarean et al. | 164/503 |
| 4,865,116 | 9/1989 | Peterson et al. | 164/467 |

*Primary Examiner*—Kuang Y. Lin
*Attorney, Agent, or Firm*—Charles W. Helzer

[57] ABSTRACT

An electromagnetic, levitation metal pipe casting method and system which provides an improved and simplified combined heat exchanger/levitator/containment coil assembly that comprises a single, outer multi-phase traveling wave coil structure and an inner solenoid coil structure. The outer, multi-phase traveling wave coil structure is positioned radially outside and coaxial with solidifing pipe during the casting process. The inner solenoid coil is positioned coaxial with and inside the pipe being cast. The outer multi-phase traveling wave coil and the inner solenoid coil are operated at substantially different frequencies and excitation current magnitudes. The improved system and method offer several functional and physical advantages over previous known levitation pipe casting systems. The principal improved features are:

1. Simplified operating and control procedures.
2. Simplified inner coil fabrication.
3. Simplified electrical and coolant connections to the inner coil.
4. Use of a single phase power supply for the inner coil instead of a multi-phase power supply.

20 Claims, 6 Drawing Sheets

Fig. 2A
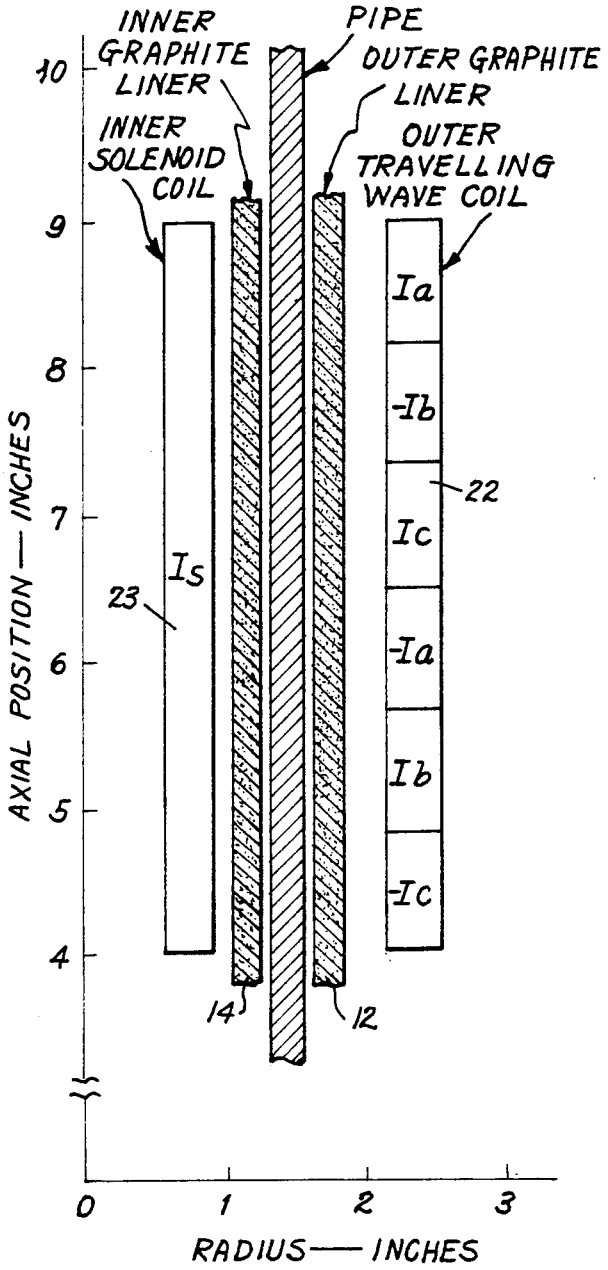
Fig. 2B
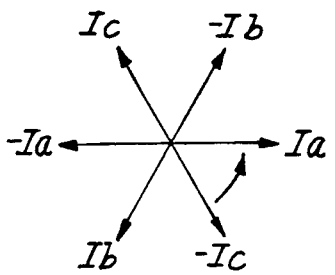
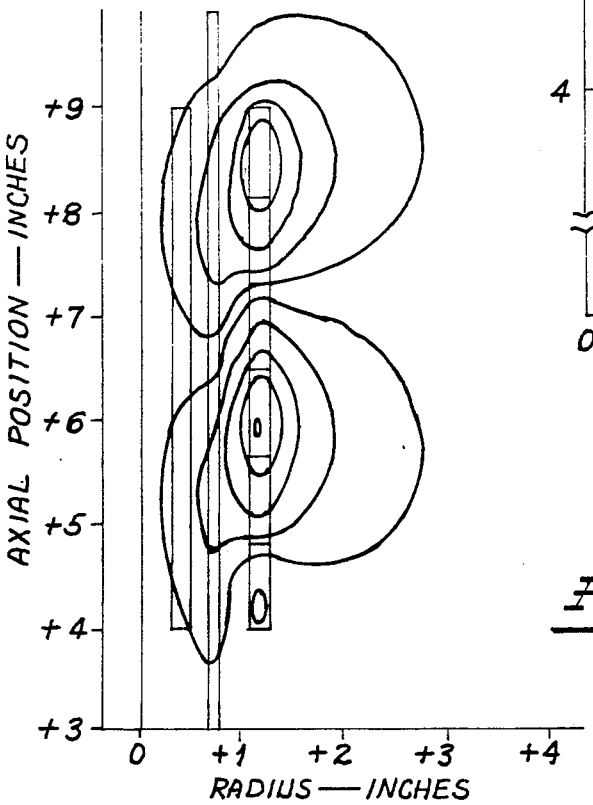
Fig. 5

CONTINUOUS METAL TUBE CASTING METHOD AND APPARATUS USING INNER SOLENOID COIL

FIELD OF INVENTION

This invention relates to a new and improved method and apparatus for the continuous manufacture of tubular metal products, such as pipe, which employs an inner, single-phase, standing wave-producing solenoid coil.

More specifically, the invention relates to the continuous manufacture of tubular metal products, such as pipe, in long lengths by up-casting in the presence of an electromagnetic levitating field for minimizing gravitational forces acting on the molten metal during solidification, and in the presence of inner and outer radially acting containment fields for reducing frictional and adhesive forces acting on the tubular metal product while still in the molten state and while maintaining maximum effective heat transfer between the tubular molten metal and a heat exchanger during solidification. In this invention the inner, outwardly extending radially acting containment force is produced by a single-phase standing wave producing solenoid coil operated within necessary restrictions on the relative electrical frequencies and phases of the excitation current in the inner and outer coil winding assemblies.

BACKGROUND PRIOR ART

U.S. Pat. No. 4,865,116 issued Sep. 12, 1989 for a "Continuous Metal Tube Casting Method and Apparatus"—Jeffrey N. Peterson and Robert T. Frost—inventors—now assigned to Showa Electric Wire & Cable Co., Ltd. of Tokyo, Japan, describes and claims a method and system to continuously cast metallic pipe. The method and system of U.S. Pat. No. 4,865,116 comprises essentially two multi-phase, traveling wave levitating assemblies, one located outside the pipe within a heat exchanger and the other located inside the pipe.

In addition to U.S. Pat. No. 4,865,116 there are a number of known prior art patents such as U.S. Pat. No. 4,414,285, issued Nov. 8, 1983 for a "Continuous Metal Casting Method, Apparatus and Product"—H. R. Lowry and Robert T. Frost, inventors, now assigned to Showa Electric Wire & Cable Co., Ltd. of Tokyo, Japan, which employ an electromagnetic levitation and containment method and system for the casting of continuous rod. These prior art patents in conjunction with U.S. Pat. No. 4,865,116 in which they are cited, provide a detailed description of the principals and implementation of the electromagnetic levitation and containment method and system. As a consequence, this disclosure will be limited to a description of the features of the levitator assembly employing a single phase solenoid coil which patentably distinguishes this invention from the previously issued pipe casting U.S. Pat. No. 4,865,116 employing two multi-phase electromagnetic levitating coils.

In addition to the above-noted prior patents and disclosures, such as U.S. Pat. No. 4,414,285, related to the electromagnetic levitation/containment casting of solid rod products, and U.S. Pat. No. 4,865,116 relating to the electromagnetic levitation/containment casting of tubular metal products, such as pipe, using multi-phase inner and outer electromagnetic levitation/containment fields producing coil assemblies, there is a further family of prior patents and disclosures which relate to the use of single phase, standing wave, electromagnetic containment field producing heat exchanger/solenoid coil assemblies in the electromagnetic casting of hollow metal ingots. This family of prior art methods and systems is typified by U.S. Pat. No. 4,126,175—issued Nov. 21, 1978—Z. N. Getselev for "Electromagnetic Mould for the Continuous and Semi-Continuous Casting of Hollow Ingots".

SUMMARY OF INVENTION

The present invention provides a tubular metal pipe casting method and system that supplies molten metal to the base of a combined heat exchanger/levitator/containment coil assembly. The magnetic fields produced by the levitator/containment coil of the assembly maintain the molten metal levitated (suspended) within the heat exchanger region wherein the molten metal solidifies and thereafter exits from the top of the heat exchanger/levitator/containment coil assembly as solid pipe. Molten metal contained in a suitable reservoir is lifted into a tubular molten metal casting vessel located within the combined heat exchanger/levitator/containment coil assembly by known techniques using an inert pressurizing gas or gravity feed (for example) where the molten metal is subjected to the levitating and containment action of electromagnetic fields while it solidifies. The solidified metal pipe then is extracted upwardly from the open-ended top of the heat exchanger/levitator/containment coil assembly by known extraction techniques employing withdrawal rolls or the like. The supply of molten metal from the reservoir to the combined heat exchanger/levitator/containment coil assembly is adjusted so that it just matches the rate of withdrawal of the solidified metal tube from the top of the assembly.

The heat exchanger/levitator/containment coil assembly produces an outer, upwardly traveling electromagnetic levitation field which acts on the molten metal within the assembly to maintain it suspended in space by reducing gravitational forces acting on the molten metal to essentially zero. Simultaneously, inwardly and outwardly directed electromagnetic radial containment forces reduce or eliminate any continuous contact pressure, frictional and adhesive forces within the walls of the tubular molten metal casting vessel comprising a part of the heat exchanger. The optimum casting condition occurs when the molten metal attains a "pressure-less contact" condition wherein gravitational, frictional and adhesive forces acting on the molten metal are reduced substantially to zero, but there is sufficient heat transfer via the "pressure-less contact" with the walls of the casting vessel to assure solidification of the tubular metal product being cast at a selected production rate.

The presently proposed tubular metal pipe casting system utilizes a combined heat exchanger/levitator/containment coil assembly that consists essentially of a single, outer multi-phase, upward traveling wave levitation and containment field producing coil and an inner, single-phase, standing wave, containment field producing solenoid coil. The upward traveling wave and containment field producing levitator coil assembly is positioned radially outside and coaxial with the tubular metal pipe being cast, and the inner solenoid coil assembly is positioned coaxial with and inside the tubular metal product being cast. Unlike the method and system disclosed in U.S. Pat. No. 4,865,116 the present outer multi-phase levitator coil and inner solenoid coil are to be operated at substantially different frequencies. The improved, outer traveling wave levitator coil/inner solenoid coil method and system of this invention offers several functional and physical advantages over the prior art double (outside and inside) multi-phase traveling wave levitator coil assembly system disclosed in U.S. Pat. No. 4,865,116.

The principal advantageous features of the present invention include, but are not limited to, the following:

1. Simplified operating and control procedures.
2. Simplified inner coil fabrication.
3. Simplified electrical and coolant connections to the inner coil.
4. Use of a single phase power supply for inner coil excitation instead of a three-phase supply previously required.

In addition to the above-noted prior art U.S. Pat. No. 4,865,116, and the prior art electromagnetic levitation/-containment metal rod casting patents exemplified by U.S. Pat. No. 4,414,285—Lowry et al, the prior art Getselev U.S. Pat. No. 4,126,175 also is of background interest with regard to the present invention. The Getselev U.S. Pat. No. 4,126,175 describes the use of solenoid field windings to provide radial acting electromagnetic field force pressures to form the external and internal surfaces of horizontally cast hollow ingots. The principal feature which distinguishes the present invention over the teachings of the prior art Lowry et al U.S. Pat. No. 4,414,285; the Peterson and Frost U.S. Pat. No. 4,865,116; and the Getselev U.S. Pat. No. 4,126,175, are the restrictions imposed on the magnitude, frequencies and phase relations of the excitation currents supplied to the inner and outer coil assemblies.

As the following discussion will illustrate, all combinations of excitation frequencies are not equally effective in producing the required lift force and the appropriate balance between the radially inward and outward containment forces. This disclosure provides the necessary restrictions on the relative electrical frequencies and phase relatons of the excitation currents supplied to the inner and outer coil winding assemblies. Suggestions are also provided for the selection of an exemplary range of excitation frequencies and phase relations for a given size heat exchanger/levitator/containment coil assembly.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference character, and wherein:

FIG. 2A is a schematic and diagrammatic view of the construction and principal parts of a combined levitator/containment coil assembly having an outer multiphase levitating coil and an inner solenoid coil and shows their physical relationship to an inner and outer graphite liner that forms a tubular molten metal casting vessel for retaining the tubular metal product being cast during solidification within a heat exchanger comprising a part of the assembly shown in FIG. 1;

FIG. 2B is a current phasor diagram illustrative of the phase relationship of the excitation currents being supplied to the outer traveling wave coil;

FIG. 6 is a plot of the axial distribution of the radial containment force produced by the inner solenoid coil of the assembly shown in FIG. 2A;

BEST MODE OF PRACTICING INVENTION

Figure 1:
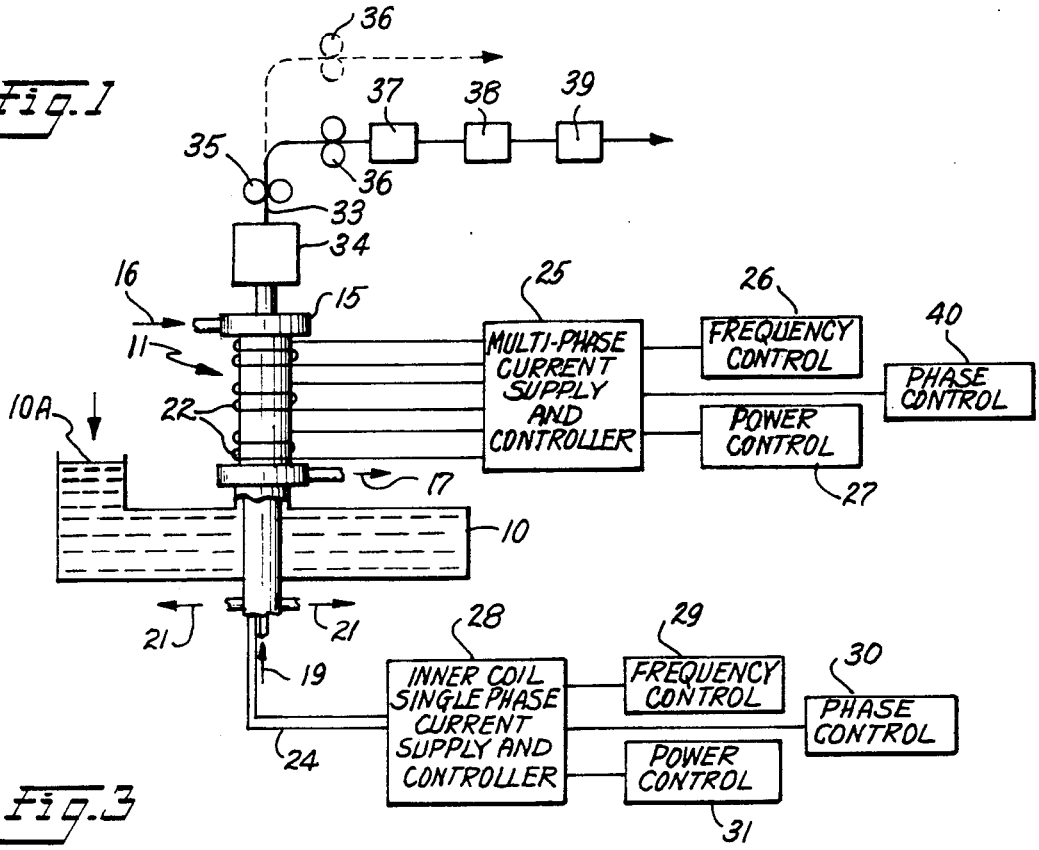
FIG. 1 is a partial, schematic, functional diagram of a new and improved tubular metal product electromagnetic levitation casting method and system according to the invention and illustrates the important elemental parts of the system and their interrelationship for use in fabricating tubular metal products according to the method of the invention.

FIG. 1 is a diagrammatic functional drawing of an apparatus suitable for producing tubular metal products of long length in a continuous manner in accordance with the teachings of the present invention. The apparatus shown in FIG. 1 is comprised by an annular-shaped molten metal reservoir 10 into which is supplied molten metal through inlet 10A out of which the pipe or other tubular metal product is to be fabricated under pressure of an inert covering gas (or by gravity flow). It is understood that the molten metal reservoir 10 will be provided with suitable refractory liner insulation and heating elements for maintaining the molten metal contained therein in a molten state.

An annular-shaped combined casting vessel/heat exchanger shown generally at 11 is disposed on the upper end of reservoir 10 with the annular-shaped interior passageway of the annular-shaped casting vessel/-heat exchanger 11 being aligned with and having access to a correspondingly shaped opening in the top of the molten metal reservoir 10. The annular-shaped casting vessel/heat exchanger 11 is comprised by an outer cylindrically-shaped graphite liner 12 (shown in FIG. 2A) which is supported on and projects into the outer side of the annular passageway formed in the top of reservoir 10. An inner graphite, mandrel liner 14 (shown in FIG. 2A) is formed in the shape of an upside down cup disposed over a central opening formed in the center of annular-shaped molten metal reservoir 10. Side walls of the inner mandrel liner 14 in conjunction with the outer liner 12 define an elongated, annular-shaped, graphite casting vessel in which the molten metal in reservoir 10 is to be solidified in the form of a desired tubular metal product such as pipe. For a more detailed drawing and description of the construction of the annular-shaped casting vessel 12, 14, reference is made to U.S. Pat. No. 4,865,116 and in particular to FIG. 1 thereof.

Disposed around the outer graphite liner 12 of the annular-shaped casting vessel immediately above the molten metal reservoir 10 is an outer annular-shaped heat exchanger 15 which provides the principal heat extraction function for the tubular casting assembly, and may be constructed and operated in the same manner as the heat exchanger shown and described in the above-noted U.S. Pat. No. 4,865,116, the disclosure of which hereby is incorporated into this application in its entirety. Cooling water or other fluid is supplied to the heat exchanger 15 through an inlet indicated by inlet arrow 16 and heated water or other cooling fluid is extracted from the heat exchanger 15 from an outlet indicated by an outlet arrow 17.

A second, internal annular-shaped, mandrel heat exchanger (not shown in FIG. 1) also may be physically disposed immediately adjacent the interior surface of the inner, upside down cup-shaped graphite liner 14 for withdrawing heat away from the inner graphite liner, at least to the extent required to keep the interior of the mandrel liner sufficiently cooled to assure safe operation of an electromagnetic solenoid coil mounted therein. Cooling water or other fluid may be supplied to the inner heat exchanger (if provided) via an inlet conduit shown by arrow 19, circulates through the inner heat exchanger and then discharges through the exit conduits shown by arrow 21. Cooling fluid is supplied to the outer heat exchanger 15 through the inlet conduit 16 and the heated cooling fluid then is extracted through the outlet conduit 17. The amount of cooling achieved with the inner mandrel heat exchanger (if required) should be sufficient to maintain the interior of the heat exchanger at a temperature which assures safe operation of an inner electromagnetic solenoid coil which is physically supported within the inner mandrel heat exchanger (as shown in FIG. 2A). Substantially all of the heat extraction required to solidify the cast tubular metal product within the solidification zone of the annular casting vessel/heat exchanger 11 takes place through the first outer heat exchanger 15. Heat exchanger 15 is not so greatly constrained in size because of its location and hence can be designed to provide adequate cooling of the molten metal to form the solidified hollow tubular metal product within the solidification zone defined by the annular-shaped combined casting vessel/heat exchanger 11.

An outer, multi-turn, multi-phase electromagnetic levitation coil winding 22 circumferentially surrounds the exterior of the outer heat exchanger 15 in the manner shown in FIG. 1 and FIG. 2A of the drawings. The outer, multi-turn, multi-phase coil 22, for example, may comprise 6 different coils interconnected for excitation in accordance with the current phasor diagram shown in FIG. 2B. The multi-phase coils 22 are disposed in vertical spaced relationship around the outer ceramic graphite liner segment 12 as shown in FIG. 2A wherein 12 comprises an outer segment and 14 an inner segment of a tubular-shaped, graphite casting vessel in which molten metal is to be solidified during casting operations. As explained more fully in the above-referenced U.S. Pat. No. 4,414,285 and specifically with relation to FIG. 3 thereof, the respective coils of the multi-turn, multi-phase winding 22 are connected to successive phases of a poly-phase electric current source 25 to create an upwardly traveling, outer electromagnetic levitation field and a significant, coextensive, radially inward extending electromagnetic containment field component which is directed inwardly substantially at right angles to the upwardly traveling levitation field so that both fields act on liquid metal within the solidification zone of the tubular casting vessel/heat exchanger 11. Control of the frequency, phase and magnitude of poly-phase current supplied from current source 25 is provided by respective frequency control sub-system 26, phase control sub-system 40 and power control sub-system 27, all of conventional known construction, and connected to control operation of multi-phase current supply and control system 28.

A second, inner, multi-turn, single phase, solenoid coil is shown at 23 in FIG. 2A of the drawings and comprises a multi-turn winding having the serially connected coils thereof lying in planes at right angles to the central axis of the inner ceramic/graphite liner 14 which together with the outer liner 12 forms the tubular-shaped molten metal casting vessel in which molten metal being cast is solidified. The insulated coils of inner solenoid winding 23 are circumferentially wound around the interior surface of the side skirt of the inner graphite liner 14. Supply electric current is provided to the inner, multi-turn, single phase, solenoid winding 23 via the supply conductors 24 shown in FIG. 1 of the drawings from an inner coil single phase current supply and controller 28. Control of the frequency, phase and magnitude of the excitation current supplied from controller 28 to the inner solenoid coil 23 is provided by respective frequency control sub-system 29, phase control sub-system 30 and power control sub-system 31.

In contrast to the method and system disclosed in U.S. Pat. No. 4,865,116, the inner, multi-turn windings of solenoid coil 23 are excited with single phase excitation current to provide an inner, standing wave that produces only an outwardly directed, radial, containment field component that extends outwardly in a direction at right angles to the upwardly acting levitation field produced by the outer multi-phase coil 22. This outwardly directed radial containment field acts to exert an outward pressure on the interior side walls of the tubular molten metal within the solidification zone defined by the tubular-shaped casting vessels 12, 14.

As noted earlier, the principal object of the invention is to create a simplified and improved combined heat exchanger/levitator/containment coil assembly that produces a levitating electromagnetic, upwardly directed lifting force that offsets the effect of gravitational forces and suspends the tubular molten metal and solidified tubular product within the heat exchanger/levitator/containment assembly while maintaining the molten metal in a "pressure-less contact" condition with the sidewalls of the tubular molten metal casting vessel. To do this most effectively, the assembly must produce radial containment restraint forces in the inner and outer surface layers of the molten metal that are of controllable value appropriately proportioned to the electromagnetic levitating lift force and directed so as to reduce or eliminate frictional and adhesive forces due to contact pressure of the molten metal with the inner and outer walls of the tubular molten metal casting vessel within the heat exchanger during solidification. The assembly also provides electromagnetic stirring of the solidifying metal to prevent the growth of large grains during solidification.

Figure 3:
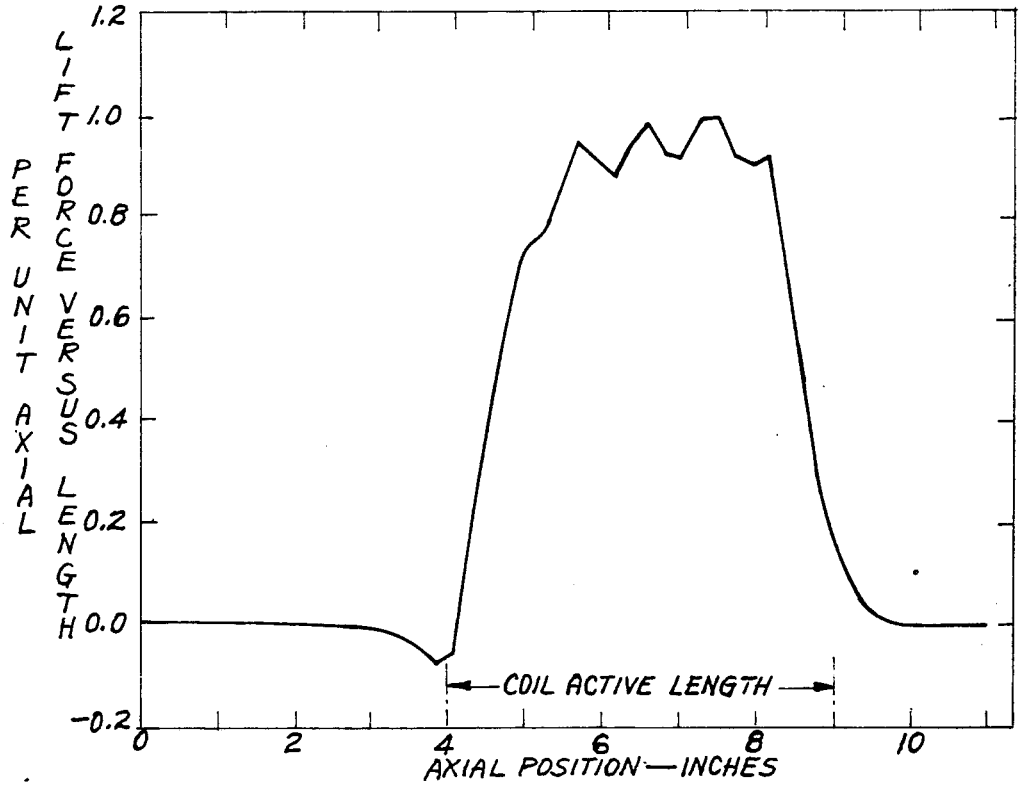
FIG. 3 is a plot showing the axial distribution of the upward, axially directed, levitating lift force produced by the outer levitating coil in a tubular metal product being cast by the coil assembly depicted in FIG. 2A.

To satisfy the above objectives, the combined heat exchanger/levitator/containment assembly is comprised by the outer, multi-phase, multi-turn traveling wave coil assembly 22 located radially outside of the tubular product being cast and the inner, multi-turn solenoid coil 23 located inside of the tubular product being cast. Both the outer and inner coils are positioned coaxial with the tubular product being cast. FIG. 2A shows the preferred implementation of this concept. The outer coil is shown as a multi-phase coil having an axial length corresponding to a single wavelength of the excitation frequency supplied to the coil, but may in actuality be configured with any integral number of half-wavelengths. Multi-phase excitation currents are applied to the outer coil 22 in accordance with the phasor diagram illustrated in FIG. 2B. These currents produce an upwardly traveling, electromagnetic levitation field that interacts with the molten metal being cast so as to create a net, upwardly directed, axial lift force in the molten metal and suspends the molten metal within the solidification zone defined by the axial length of combined heat exchanger/levitator/containment coil assembly 11. The axial distribution of the levitator axial lift force produced in the tubular metal product within the solidification zone is shown in FIG. 3 of the drawings.

Figure 4:
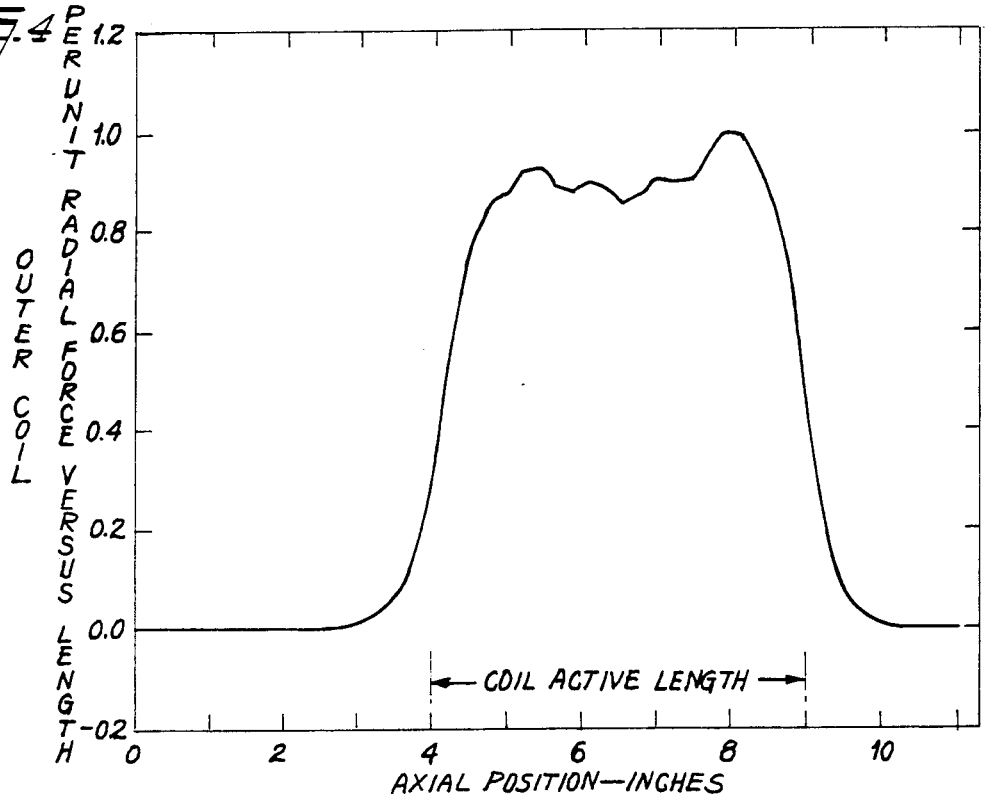
FIG. 4 is a plot of the axial distribution of the radial containment force produced by the outer levitating coil of the assembly shown in FIG. 2A.
Figure 5:
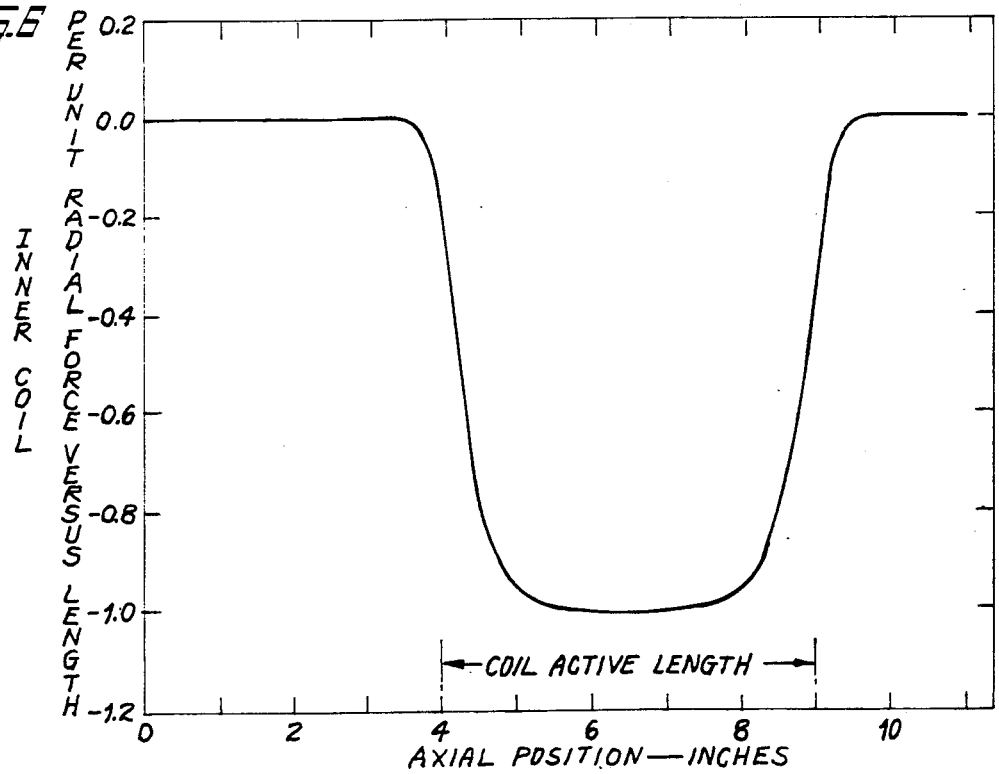
FIG. 5 is a plot of the magnetic flux pattern produced by the outer levitating coil of the assembly shown in FIG. 2A.

In addition to the levitating axial lift force, the outer levitator coil 22 also produces containment forces in the tubular molten metal and solidifying pipe that are directed radially inward at right angles to the lift force, and which tend to move the solidifying pipe away from the outer wall 12 of the tubular casting vessel 12, 14 within the heat exchanger/levitator/containment coil assembly. The axial distribution of the inwardly directed, radial containment forces generated in the tubular metal product by the outer levitation coil 22 is shown in FIG. 4 of the drawings. In both FIG. 3 and FIG. 4 the axial force per unit length is plotted as the ordinate and the axial position in inches is plotted as the abscissa. The magnitude of the forces produced in the tubular metal product are proportional to the square of the coil excitation current magnitude. The slight ripple in the force magnitude illustrated in FIGS. 3 and 4 is a spatial effect that is caused by the lumped current distribution in the levitation coil. A typical magnetic field pattern that is produced by the outer levitator coil assembly is shown in FIG. 5 of the drawings.

The magnetic fields produced in the tubular metal product by the inner solenoid coil 23 are primarily radially directed as depicted in FIG. 6 of the drawings. From a comparison of FIG. 6 to FIG. 4, it will be seen that the radial containment force produced by inner solenoid coil 23 is in a direction opposite to the inwardly directed radial containment force produced by outer levitation coil 22. However, since the excitation current in the inner solenoid coil is single phase alternating current, the magnetic field pattern produced by coil 23 remains stationary in the manner of a standing wave. This stationary field will oscillate at the frequency of the excitation current supplied to solenoid coil 23. As with the outer traveling wave coil 22, the magnetic fields produced by the inner solenoid coil 22 will interact with the tubular molten metal and solidifying pipe to produce forces in the pipe. These forces are primarily directed radially outward and will tend to move the solidifying pipe away from the inner wall of the inner ceramic/graphite liner 14 which comprises part of the tubular-spaced casting vessel within the heat exchanger/levitator/containment coil assembly 11.

Figure 7:
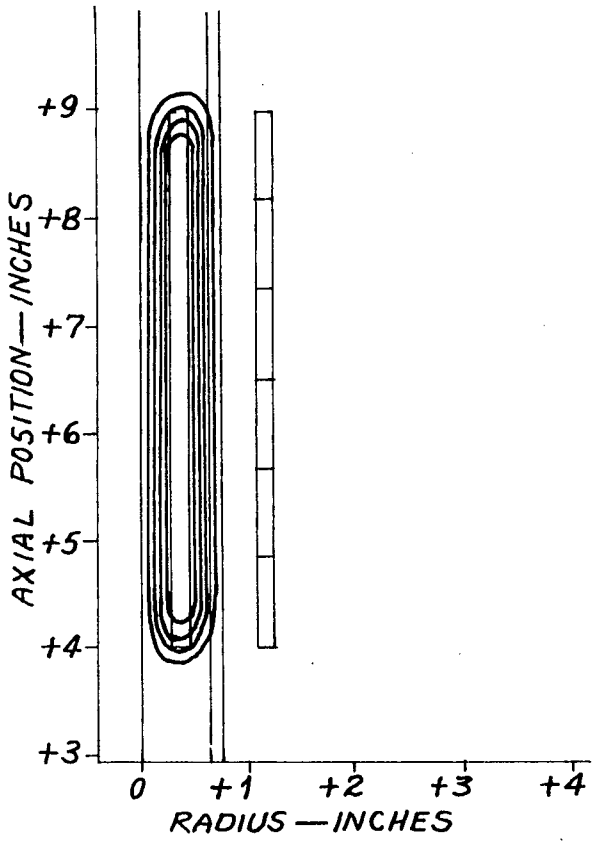
FIG. 7 is a plot of the magnetic flux pattern produced by the inner solenoid coil of the assembly shown in FIG. 2A.

The axial distribution of the above-discussed radial forces is shown in FIG. 6 of the drawings. At this point in the description, it should be noted that the excitation of inner and outer coils 23 and 22 must be selected such that the net radial forces produced at each axial position along the length of the tubular molten metal and solidifying pipe within the solidification region of the heat exchanger/levitator/containment assembly 11 is zero. Otherwise, the tubular molten metal and solidifying pipe would move radially. It should also be noted that there are no significant lift forces produced in the tubular molten metal and solidifying pipe by the inner solenoid coil 23. FIG. 7 shows the magnetic flux pattern produced by the inner solenoid coil.

The proper selection of operating frequencies for the excitation current supplied to the inner and outer coils is important for the successful operation of the levitation casting method and system according to the invention. Not all possible combinations of frequency are equally advantageous or necessarily feasible for producing the appropriate distribution of forces or the necessary balance between the radially inward and outwardly directed containment forces. The traveling wave/traveling wave levitator assembly described in U.S. Pat. No. 4,865,116 which is excited by currents that are essentially at the same frequency. In contrast, the traveling wave/solenoid levitator assembly of the present invention is most effective when the frequencies are different. The frequency of the magnetic fields and currents produced in the tubular molten metal and solidifying pipe by a coil will match the frequency of the excitation current supplied to the coil. If the inner and outer coils are operated at different frequencies, magnetic field quantities produced by each of the coils will also be at different frequencies. Each coil therefore will produce a force distribution in the molten metal and solidifying pipe that consists of a steady-state component and a second component that oscillates at twice the frequency of the excitation current supplied to the coil. The time-average of this double frequency component is zero so that for all practical values of excitation frequency, this double frequency force component will produce negligible oscillatory motion in the molten metal and solidifying pipe.

In addition to the forces produced by the self-induced fields in the tubular molten metal and solidifying pipe, the magnetic fields from the inner and outer coils also will interact to produce forces in the metal. The forces thus produced will be of the form:

$$F \propto J_o B_o \sin^2(2\pi ft)\cos(2\pi\Delta ft) + \tfrac{1}{2} J_o B_o \sin(4\pi ft)\sin(2\pi\Delta ft)$$

where f is the frequency of the first coil
$f+\Delta f$ is the frequency of the second coil
$J_o$ is the current density and
$B_o$ is the magnetic flux density.

For practical ranges of excitation frequencies, the second component of the equation above will produce an oscillatory motion that will have little effect on the tubular molten metal and solidifying pipe. However, the first component contains a high frequency term $J_oB_o \sin^2(2\pi ft)$ whose time average is $\frac{1}{2} J_oB_o$. This term is modulated by the beat frequency term, $\cos(2\pi\Delta ft)$. Although the time average of the first component also is zero, it may produce undesirable motion of the tubular molten metal and solidifying pipe if the beat frequency ($\Delta f$) is low. The operating frequencies of the inner and outer coils therefore should be chosen such that the difference between the frequencies is large enough to minimize the effects of the beat frequency component and should exceed 100 hertz (i.e., $\Delta f > 100$ hertz).

In general, the radially acting containment forces produced in the tubular molten metal and solidifying pipe by the inner and outer coils increase with increasing frequency. The lift force produced in the tubular molten metal and solidifying pipe by the traveling wave levitation coil increases with frequency to a maximum value at a specific frequency and then decreases as the frequency is further increased. The selection of the excitation frequencies for the levitator and solenoid coil therefore should take into account these characteristics. In particular, the inner solenoid coil should be excited at a relatively high frequency (e.g. 9600 hertz) to provide relatively high radial forces at lower excitation current magnitudes. The outer traveling wave levitator coil correspondingly should be operated at a comparatively lower frequency (e.g. 2400 hertz) so that the necessary lift force can be produced in the tubular molten metal and solidifying pipe.

In any practical application, the excitation currents supplied to the inner solenoid and outer levitator coils will probably contain harmonic components. An additional restriction that should be placed on the selection of the excitation current frequencies is that the fundamental frequencies and the principal harmonics do not coincide. For example, if the outer levitator coil frequency is chosen to be 1000 hertz and the inner solenoid coil frequency is 5000 hertz, the fifth harmonic component of the outer levitator coil will interact with the fundamental frequency component of the inner solenoid coil. Depending on the phase relationship between these components, this interaction may produce forces that add constructively or destructively to the forces produced by the self-induced fields induced in the tubular molten metal and solidifying pipe.

Provided that the above restrictions as to the relative frequency of the respective inner and outer coil excitation currents are imposed on the coil frequency selection, there will be no significant forces produced in the tubular molten metal and solidifying pipe due to the interaction of the inner and outer coil fields. Thus, each coil assembly will establish a distribution of forces in the tubular molten metal and solidifying pipe that is completely independent of the distribution produced by the other coil assembly. The net force distribution produced in the tubular molten metal and solidifying pipe is simply the vector sum of the force distributions produced by each coil assembly. This operating mode will allow independent control of the radially outward containment forces produced by the inner solenoid coil and the radially inward containment forces produced by the outer levitator coil.

Figure 8A:
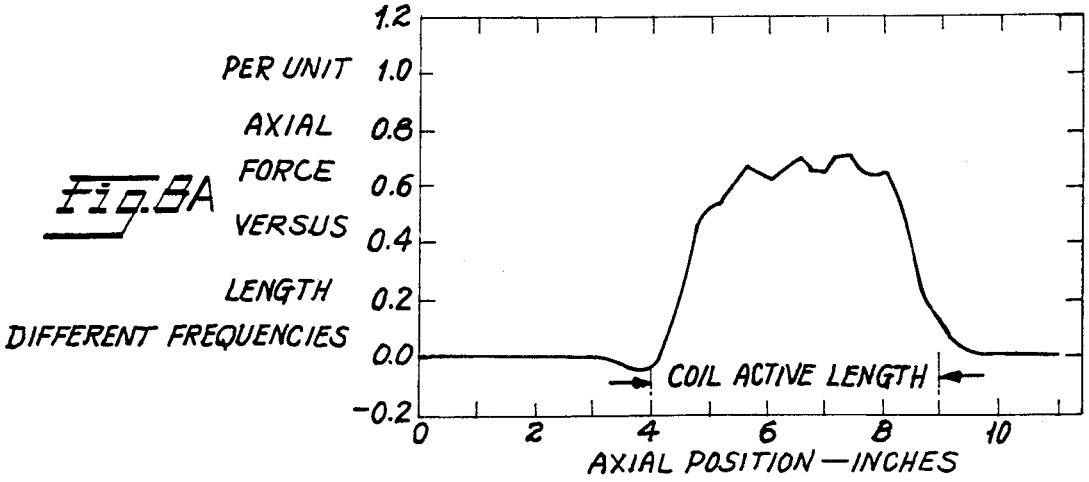
FIG. 8A (which was previously presented as FIG. 3) shows the axial distribution of the levitating lift forces produced in the tubular metal product being cast under conditions where the inner and outer coils are operated at different frequencies.
Figure 8B:
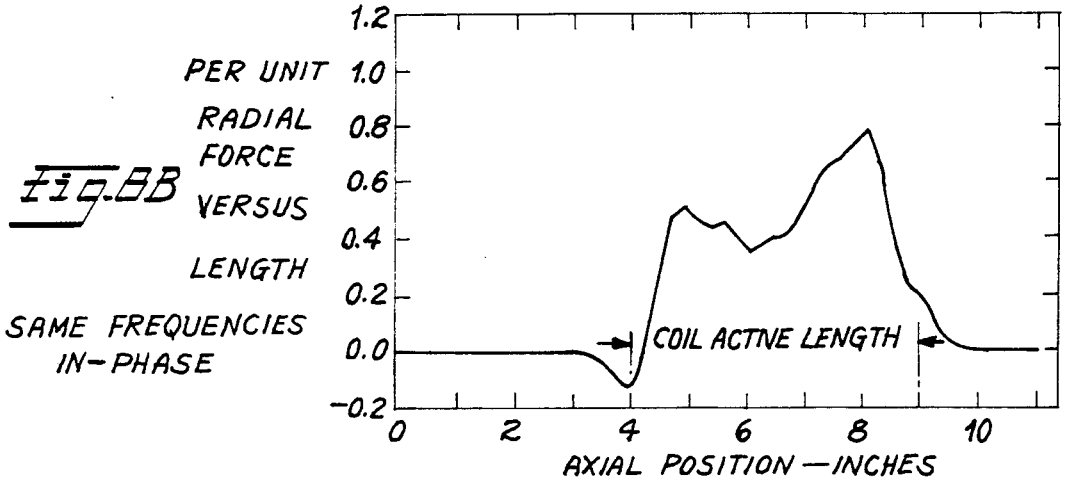
FIG. 8B shows the axial force distribution under conditions where the coils are operated at the same frequency with the inner solenoid coil excitation current in-phase with the uppermost coil of the outer traveling wave coil.
Figure 8C:
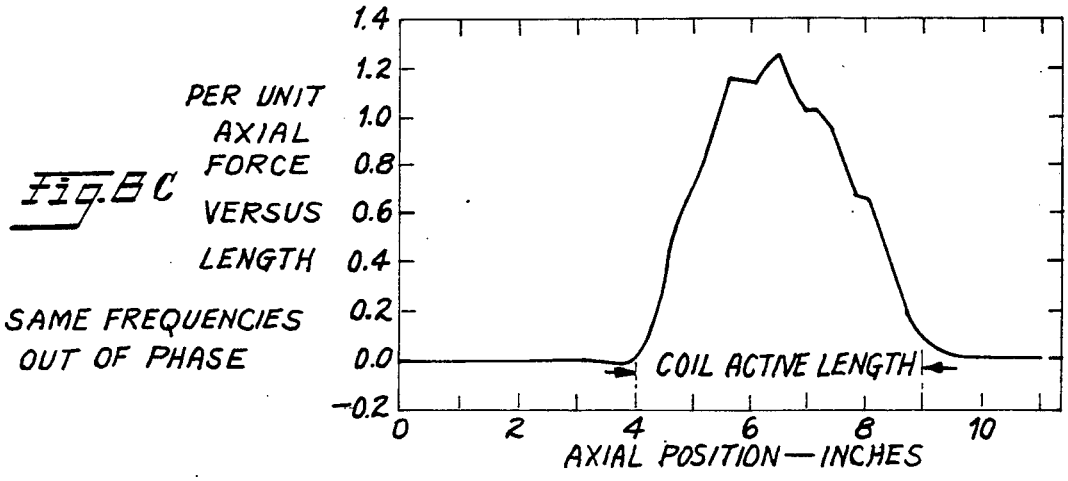
FIG. 8C shows the force distribution when the coils are operated at the same frequency, but with the inner solenoid coil excitation 180 electrical degrees out of phase with the uppermost coil of the outer coil structure.

If the inner and outer coils are operated at the same excitation frequency, the fundamental frequency components of the fields produced by the two coils will interact to produce additional forces in the tubular molten metal and solidifying pipe. These additional forces will add constructively or destructively depending upon the relative phases of the excitation coil currents. In either case, a non-uniform axial lift force distribution will result. This characteristic is readily apparent from the axial lift force distribution presented in FIG. 8A and 8B. FIG. 8A (which previously was presented as FIG. 3) shows the axial distribution of the lift forces produced in the tubular metal product when the inner and outer coils are operated at different frequencies. FIG. 8B shows the same force distribution when the inner and outer coils are operated at the same frequency with the excitation current supplied to the inner solenoid in phase with the excitation current supplied to the uppermost coil of the outer levitator traveling wave coil assembly. FIG. 8C shows the distribution under circumstances where the coils are operated at the same frequency, but with the inner solenoid coil excitation current 180 electrical degrees out of phase with the excitation current supplied to the uppermost coil of the outer levitator coil assembly. These figures illustrate the non-uniformities that are introduced into the axial lift force distributions through the use of different frequencies and phase relations. Similar non-uniformities appear in the axial distribution of the radial containment forces.

The basic theory for control of the combined heat exchanger/levitator/containment coil assembly of this invention is that the outer levitator coil provides all of the electromagnetic lift force required to maintain the tubular molten liquid metal suspended within the tubular casting vessel 12, 14 within the heat exchanger/levitator/containment coil assembly 11 after the molten liquid metal has been raised to a level where it is within the field of action (i.e. solidification zone) either by a covering inert gas pressure or the force of gravity applied to the molten liquid level inlet 10A of reservoir 10. The outer levitator coil 22 also produces inwardly acting radial containment forces that are directed inwardly and act on the tubular molten liquid metal to cause it to be displaced away slightly relative to the inside wall of the outside ceramic/graphite liner 12 comprising the tubular casting vessel so as to cause it to be maintained in a "pressure-less contact" condition with respect to liner wall 12 as explained earlier above. Simultaneously, the inner solenoid coil 23 produces only radially outwardly directed containment forces which serve to maintain the tubular liquid molten metal displaced away from the outer side wall surfaces of the inner ceramic/graphite liner 14 to form a "slight gap" in a "pressure-less contact" condition. When the inner and outer currents have their frequencies, phase and magnitude properly adjusted, the inward and outwardly directed radial containment forces will balance, and the tubular molten metal and solidifying pipe will experience no net radial motion.

The procedure for selecting the inner and outer coil excitation current frequencies and magnitudes is fairly straightforward. First, the current magnitude supplied to the outer levitator coil assembly and its frequency is chosen to provide a levitation ratio of approximately 1.5. The levitation ratio is defined as the ratio of the axial length of the tubular liquid metal and solidifying pipe that is supported by the magnetic lift field to the active length of the coil. For the coil assembly shown in FIG. 2 that has a magnetically active length of approximately 5 inches, a levitation ratio of 1.5 would correspond to a tubular liquid metal and solidifying pipe length of 7.5 inches.

Figure 9A:
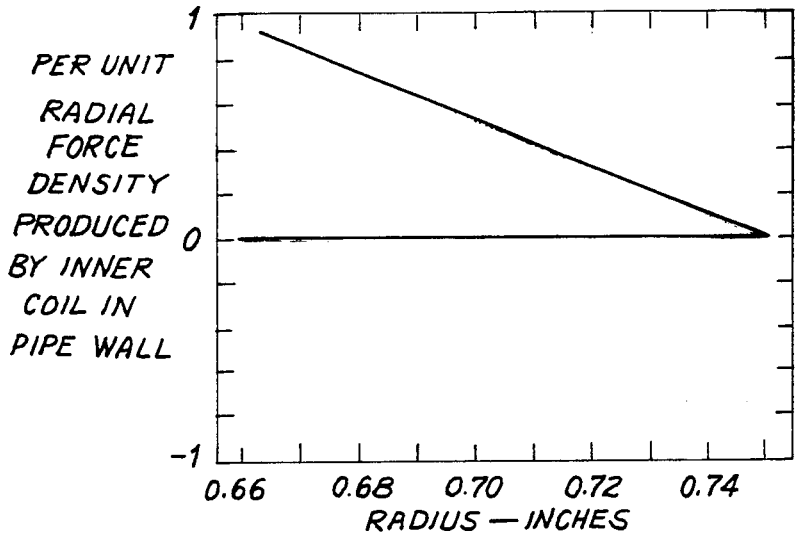
FIG. 9A is a plot of the radial force density produced by the inner coil structure.
Figure 9B:
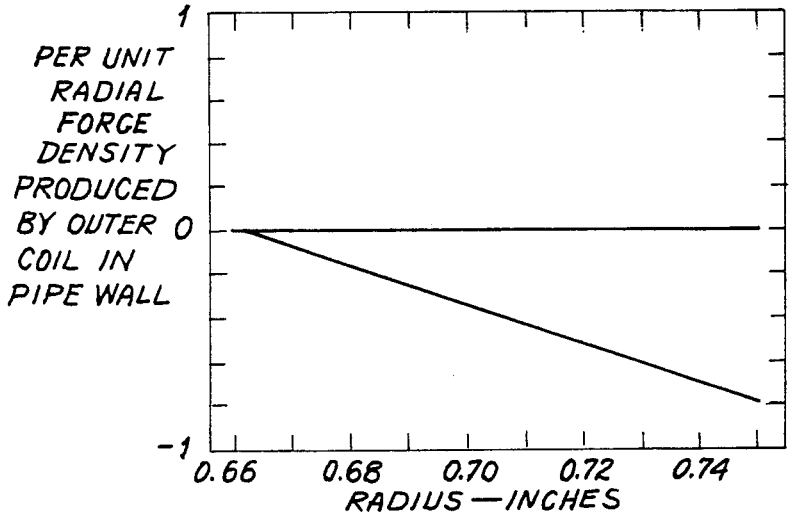
FIG. 9B is a plot of the radial force density produced by the outer coil structure.
Figure 9C:
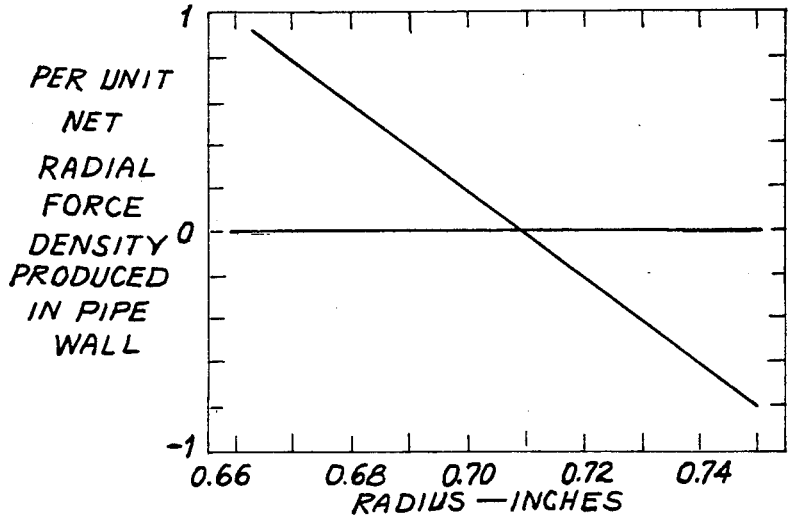
FIG. 9C is a plot of the net radial force density acting on the molten tubular metal product as it solidifies.

Once the outer levitator coil current magnitude and frequency have been selected, the inner coil current magnitude and frequency is chosen such that the net radial containment force produced in the tubular liquid metal and solidifying pipe by the inner solenoid coil is exactly equal in magnitude to the net radial containment force produced by the outer levitator coil. FIG. 9A shows the radial force profile produced in a sample cast pipe wall at an arbitrary axial position by the inner solenoid coil assembly 23. The sample pipe selected has an inside diameter having a radius r=0.66 inches and an outside diameter having a radius r=0.75 inches. For simplicity the radial containment force densities have been per-unitized and plotted as a function of radial position. FIG. 9B illustrates the inwardly directed radial containment force density produced by the outer levitator coil structure 22. FIG. 9C shows the net radial force density produced in the example pipe selected under balanced operating conditions.

Figure 10:
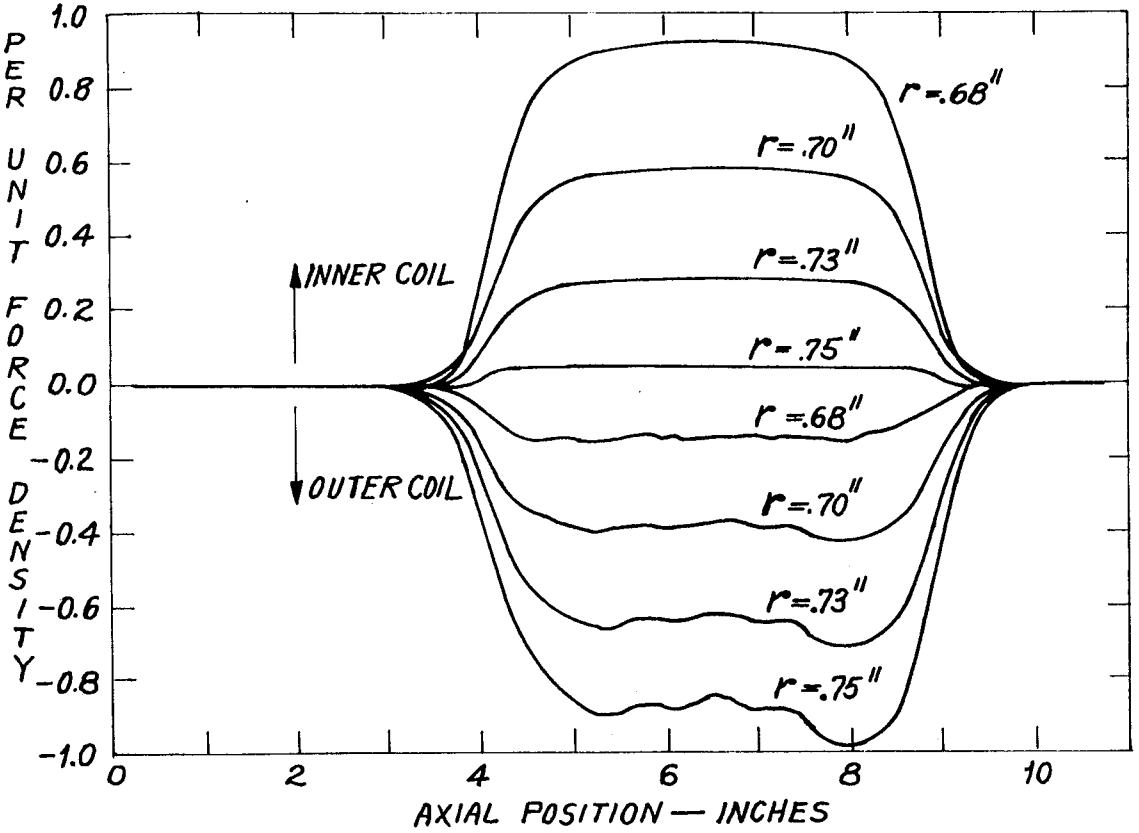
FIG. 10 is a plot of the combined radial force densities at different radii as a function of axial position along the axial length of the tubular metal product being cast in the solidification region.

The radial containment force densities produced by the inner solenoid and the outer levitator coil are plotted as a function of axial position in FIG. 10 of the drawings at four different radial locations within the solidified pipe wall. As can be seen in FIG. 10, the net radial containment force near the solidifying pipe inside diameter (r=0.66 inches) is outwardly directed and is predominately produced by the inner solenoid coil. Similarly, near the pipe outside diameter (r=0.75 inches) the net radial containment force is directed radially inward and is determined primarily by the outer levitator coil. In addition, it will be seen that the radial containment force profiles are reasonably well matched along the axial length of the solidification zone which may preclude the need for external balance of the profiles by adjustment of the inner and/or outer coil geometries. If necessary, however, the turns spacing of either the inner solenoid coil and/or the outer levitator coil can be adjusted to provide axial force profiles that are more precisely balanced.

In operation, molten metal prepared in a holding furnace (not shown) is supplied to the reservoir chamber 10 through inlet 10A by means for supplying and controlling introduction of liquid metal from a holding furnace into chamber 10 by controlled gravity pouring, or by pressurization with an inert gas cover in a known manner. The liquid metal in chamber 10 is displaced from the reservoir upwardly into the lower portion of the annular casting vessel defined by the outer and inner graphite liner segments shown at 12 and 14 in FIG. 2A. The arrangement is such that either by gravity flow or due to pressurization by an inert gas cover, the molten metal is caused to rise within the annular casting vessel to a level just above the lower ends of outer and inner sets of coils 22 and 23. The holding furnace and its associated molten metal supply system (not shown) is designed to controllably deliver inlet molten metal into reservoir chamber 10 either intermittently or continuously as necessary during continuous operation of the process in order to maintain this starting level of molten metal within the annular-shaped casting vessel 12, 14. At this level, the molten metal will come under the influence of the upwardly traveling electromagnetic levitation field produced by outer coil 22 and the radially directed inner and outer containment fields produced by outer coil 22 and inner solenoid coil 23.

During initial start-up, a starter lifting tubular member (not shown) is introduced thru the open upper end of the annular-shaped casting vessel 12, 14 and the lower end of the starter tube is brought into contact with the top surface of the tubular liquid metal column formed by the rising molten metal within the annular-shaped casting vessel. With cooling water or other cooling fluid running at full velocity through the respective heat exchangers 15 and 19, 21, the upper portion of the tubular liquid metal column will be solidified in contact with the starter tubular member. The starter tubular member and accreted solidified tubular column then will be withdrawn upwardly from the annular-shaped casting vessel 12, 14 by suitable withdrawal rolls 35 and 36 as shown in FIG. 1. The starter tube and accreted tubular metal product will be withdrawn at a rate determined by the rate of formation of tubular metal product and in turn determines the rate of production of the continuous casting system. During solidification within the solidification zone defined essentially by the length of the multi-turn coils 22 and 23, the liquid metal column both in its molten and solidified form will be maintained in a substantially weightless and pressureless condition by the upwardly traveling, electromagnetic levitation field as described in greater detail in the above-referenced U.S. Pat. No. 4,414,285, the disclosure of which hereby is expressly incorporated into the disclosure of this application.

During operation, the tubular liquid metal column within the solidification zone and during levitation in the above-described manner, becomes subject to a unique and unexpected self-regulating characteristic. Due to this self-regulating characteristic, if the tubular liquid metal column is accelerated upwards because the levitation force suddenly becomes greater than the weight force of the liquid metal column, it produces a reduction in the cross sectional area of the column. This then results in an automatic reduction in the lifting force as a consequence of the reduction of the cross section of the liquid metal column caused by the greater levitation force. Consequently, a slowing of the upward movement of the tubular liquid metal column automatically will occur so that the system stabilizes itself and becomes self-regulating. The opposite situation also is true in that if the tubular metal column is decelerated due to a reduction in the levitation force, there will be an increase in the cross section of the tubular liquid metal column which results in increasing the levitation force acting on the column and thereby accelerating the upward movement of the tubular liquid metal column. Thus, within the levitation zone (i.e. the zone where the upwardly traveling electromagnetic levitation field acts on the tubular metal column either in its molten or solidified state) it will be seen that the system is inherently self-regulating once it is placed in operation to effect substantially weightless and pressureless levitating support of the solidified product and tubular liquid metal column within the solidification zone as described above.

The gap between the inner and outer surfaces of the tubular metal column and their respective opposing sidewalls of the annular casting vessel, if allowed to become too large due to the containment component of the outer, upwardly traveling levitating electromagnetic field or the inner solenoid coil, could seriously impair effective heat transfer between the tubular liquid metal column and the opposing side surfaces of the annular casting vessel. This should not be allowed to happen since there is known to be a strong inverse relationship between field strength and heat removal rate. Consequently, the frequency and levitation field force density of outer coil 22 and inner solenoid coil 23 should be adjusted at the start of a casting operation to provide the desired "pressure-less contact" as defined above with minimum gap spacing consistent with good thermal transfer. The field strength then should be maintained at this setting and should not be changed during the casting operation even though the rate of removal (line speed) of the tubular liquid metal column and solidifying product through the solidification zone region might be changed.

Referring again to FIG. 1 of the drawings, it will be seen that as the solidified tubular metal product is withdrawn from the upper end of the tubular casting vessel and levitator assembly 11, it is withdrawn through a pre-cooling chamber 34 by two sets of withdrawal rolls 35 and 36 and delivered to two tandem hot-rolling stations 37 and 38, cooled and then further coiled at a coiling station 39. Alternatively, if the solidified tubular metal product has the correct diameter for use in an as-cast condition, (with or without cold drawing), it is withdrawn from the pre-cooling chamber 34 by withdrawal rolls 35 and 36 and delivered for subsequent cooling to ambient temperature and coiling. As explained more fully in the above-referenced and incorporated U.S. Pat. No. 4,414,285, the upwardly traveling electromagnetic levitating field also electromagnetically stirs the molten liquid metal, and this stirring by means of eddy currents induced in the liquid metal, results in a dense, homogeneous solidified product having fine grain structure.

During operation, the casting speed (i.e. the line speed of the tubular liquid metal product passing through the heat exchanger/levitator assembly 11) should be controlled by control of the drive motors for the tubular product removal rolls 35 and 36 which are synchronized with the rolling mills 37 and 38 and coiling mechanism 39. The levitation field strength and excitation frequency for both the outer and inner coils should be established at a value calculated for the particular size and resistivity of the tubular metal being cast to give a levitation ratio in the range between 75% and 200% where levitation ratio is defined as the ratio of the levitation force per unit of length of the liquid metal to the weight per unit length of the liquid metal as explained more fully in the above-referenced U.S. Pat. No. 4,414,285. The frequency of the excitation currents supplied to the respective outer levitating and inner solenoid coil should be in accordance with the description set forth above.

In a practical process and system employing the invention, the electromagnetic levitation casting system should be started at a lower than normal line speed and higher than normal levitation ratios in order to assure reliable start-up. After reaching steady-state operating condition (which should occur within two or three minutes) the line speed then would be increased manually in steps and the levitation field strength decreased in steps until close to a maximum casting rate is achieved in terms of tons per hour of conversion of molten metal to the solidified tubular metal product. The systém then is maintained at this setting during the course of the run. Normally it would be desirable to monitor the temperature of the emerging solidified tubular metal product by monitoring the product as it exits the annular-shaped casting vessel/heat exchanger 11 either visually or with a pyrometer to assure successful production runs.

INDUSTRIAL APPLICABILITY

The invention makes available a novel method and apparatus employing a heat exchanger/levitator/containment coil assembly for continuously casting tubular metal products such as pipe in the presence of an upwardly traveling levitating electromagnetic field and radially acting containment field which cooperate to greatly reduce gravitational, frictional, and adhesive forces acting on the solidified metal tube. The novel heat exchanger/levitator/containment coil assembly produces a first outer, upwardly traveling electromagnetic levitation field which acts on the molten metal within the assembly to maintain it suspended in space by reducing gravitational forces to essentially zero. Simultaneously, inwardly and outwardly directed electromagnetic radial containment forces are provided both by the levitator coil and the inner solenoid coil to reduce or eliminate any continuous contact pressure, frictional and adhesive forces within the walls of the molten metal casting vessel comprising a part of the heat exchanger assembly. Optimum casting conditions occur when the molten metal is maintained in a "pressure-less contact" condition wherein gravitational, frictional and adhesive forces acting on the tubular molten metal are reduced substantially to zero, but there is sufficient heat trasfer via the "pressure-less contact" condition with the walls of the casting vessel to assure solidification of the tubular metal product being cast at a selected production rate.

The principal advantageous features of the present invention include but are not limited to the following:

1. Simplified operating and control procedures.
2. Simplified inner coil fabrication.
3. Simplified electrical and coolant connections to the inner coil.
4. Use of a single phase power supply for inner coil excitation instead of a polyphase supply previously required.

Having described a novel method and apparatus employing an inner solenoid coil to produce solidified tubular metal product according to the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A continuous casting method for producing hollow tubular metal product of long length which comprises the steps of forming a hollow tubular liquid metal column within an annular casting vessel, advancing the hollow tubular liquid metal column into a heat exchanger solidification zone of the casting vessel while simultaneously electromagnetically maintaining a substantial part of the length of the hollow tubular liquid metal column within said solidification zone electromagnetically levitated with a first outer, upwardly traveling electromagnetic levitation field and an inwardly directed containment field and a second inner electromagnetic outwardly directed single phase containment field the combined action of which serve to reduce the hydrostatic head of the column and to electromagnetically contain the column, establishing a predetermined dimensional relationship between the outer and inner surfaces of the hollow tubular liquid metal column and the surrounding interior surfaces of the outer and inner side walls of the casting vessel, and separately controlling the frequency, phase and magnitude of the electromagnetic levitation and containing fields so that the inward and outward containment forces are balanced and the solidifying hollow tubular product within the solidification zone experiences no net radial force and the cross sectional dimension of the liquid metal column is less than the cross sectional dimensions of the annular casting vessel to form a slight gap that is sufficiently small and prevents formation of a substantial gap between the outer and inner surfaces of the hollow tubular liquid metal column and the surrounding interior surfaces of the outer and inner side walls of the annular casting vessel thereby effecting pressureless contact while providing sufficient heat transfer between the hollow tubular liquid metal column and the casting vessel to assure solidification while simultaneously reducing gravitational, frictional and adhesive forces to a minimum, the outer electromagnetic levitation and containment fields being operated at a first frequency f, the inner electromagnetic containment field being operated at a second and higher frequency $f+\Delta f$ and the difference $\Delta f$ between the two frequencies being large enough to minimize the effects of the beat frequency component between the outer and inner electromagnetic fields, and the casting method being completed by continuously removing solidified hollow tubular metal product from said solidification zone as the column is being electromagnetically contained and maintained in a levitated state.

2. The continuous casting method of claim 1 wherein the difference $\Delta f$ between the outer and inner electromagnetic field frequency is greater than 100 hertz ($\Delta f > 100$ hertz).

3. The continuous casting method of claim 2 wherein the operating frequencies of the outer and inner electromagnetic fields are chosen such that the fundamental frequencies of the outer and inner electromagnetic fields do not coincide with the principal harmonics thereof whereby the net force distribution produced in the tubular product being cast is the vector sum of the force distributions produced by the respective outer and inner containment fields.

4. The continuous casting method of claim 3 wherein the vector sum of the electromagnetic containment force distributions is controlled by independently controlling any of the magnitude, frequency phase of the excitation currents supplied to produce the respective outer electromagnetic levitation and containment fields and the inner electromagnetic containment field.

5. The continuous casting method according to claim 4 wherein the outer electromagnetic levitation and outer containment field is produced by an outer multiphase traveling wave producing coil and the inner outwardly directed containment field is produced by an inner, single phase, standing wave field producing solenoid coil.

6. The continuous casting method according to claim 5 wherein the geometry and particularly the turns spacing between the coils of the respective outer levitation and containment field producing coil and the inner solenoid coil are adjusted to provide opposing containment field forces that are more precisely balanced to further assure that no net electromagnetically induced radial force is produced in the tubular liquid metal column during casting.

7. The method of claim 4 in which the electromagnetic levitation and inwardly directed containment field producing means includes a plurality of electromagnetic coils for connection to successive phases of a polyphase electric current source for producing the upwardly traveling, alternating electromagnetic levitation and inwardly directed containment fields.

8. The method of claim 7, including a reservoir chamber to contain a bath of liquid metal communicating with the lower end of the annular casting vessel, and continuously moving the liquid metal upwardly into the casting vessel to a level above the lower end of the electromagnetic levitation and containment fields.

9. The method of claim 8 further including precooling the solidified hollow tubular metal product as it emerges from the upper portion of the annular casting vessel, rolling the product to a desired dimension and thereafter cooling the rolled product to an ambient temperature.

10. The method of claim 8 further including precooling the solidified hollow tubular metal product, and thereafter cooling the product to an ambient temperature.

11. Continuous hollow tubular metal product casting apparatus comprising an elongated annular-shaped tubular casting vessel disposed in upright position to receive liquid metal for solidification, means for delivering liquid metal into a lower portion of the annular-shaped casting vessel to thereby form a hollow tubular liquid metal column, heat exchange means associated with the vessel for continuously cooling and solidifying the hollow tubular liquid metal column therein, means for continuously removing solidified hollow tubular metal product from an upper portion of the casting vessel, outer electromagnetic upwardly traveling wave levitation and inwardly directed containment field producing means disposed around the outside of the annular-shaped casting vessel along a portion of its length, inner single phase, standing wave, radially outwardly directed electromagnetic containment field producing means disposed within the center of the annular-shaped casting vessel for producing a second outwardly directed electromagnetic containment field in addition to the first outer, inwardly directed electromagnetic containment field produced by said first electromagnetic levitation and containment field producing means, means for balancing the inner and outer electromagnetic containment fields so that the solidifying hollow tubular product experiences no net radial force, said levitation and containment field producing means serving to reduce the hydrostatic head of the hollow tubular liquid metal column and maintain a pressureless contact condition by establishing a slight gap between the outer and inner surfaces of the hollow tubular liquid metal column and the surrounding surfaces of the annular-shaped casting vessel, means for maintaining the value of the outer and inner electromagnetic levitation and containment fields so that the cross sectional dimensions of the hollow tubular liquid metal column is sufficiently large to preclude formation of a substantial gap between the outer surfaces of the hollow tubular liquid metal column and the surrounding interior surfaces of the outer and inner side walls of the annular-shaped casting vessel thereby providing sufficient heat transfer between the hollow tubular liquid metal column and the annular casting vessel to assure solidification while simultaneously reducing gravitational, frictional and adhesive forces to a minimum, means independent from said outer and inner electromagnetic levitation and containment field producing means for moving the hollow tubular liquid metal column upwardly through the casting vessel, and means for removing the solidified hollow tubular metal product from the upper portion of the vessel.

12. Continuous casting apparatus for producing solidified hollow tubular metal product from liquid metal, comprising an annular elongated casting vessel disposed in an upright position for receiving therewithin liquid metal to be solidified in tubular form; heat exchange means surrounding the annular casting vessel along at least a portion of the length thereof for cooling and solidifying liquid metal in the annular casting vessel; outer multi-phase upwardly traveling wave producing electromagnetic levitation and containment field producing coil means disposed around the outside of the annular casting vessel and inner single phase standing wave solenoid coil means disposed within the annular casting vessel along at least a portion of its length for simultaneously producing an outer upwardly traveling electromagnetic levitation field for reducing the gravitational forces acting upon the liquid metal to a minimum and for simultaneously producing inwardly and outwardly radially directed electromagnetic containment fields for reducing frictional and adhesive forces between the side surfaces of the liquid metal and the inner side surfaces of the annular casting vessel by reducing the cross sectional area of the liquid metal to thereby establish a slight gap but precluding formation of a substantial gap between the side surfaces of the liquid metal and the interior side surfaces of the annular casting vessel so that there is no substantial reduction in the transfer of heat between the liquid metal and the heat exchange means the metal is when being solidified; the outer electromagnetic levitation and containment coil means being operated at a first frequency f, the inner electromagnetic containment solenoid coil means being operated at a second and higher frequency $f+\Delta f$ and the difference frequency $\Delta f$ between the two frequencies being large enough to minimize the effects of the beat frequency component between the outer and inner electromagnetic fields, means independent of the electromagnetic field producing means for moving liquid metal upwardly into the tubular casting vessel and within the lower portion of the electromagnetic levitating and containment fields; separately controlled means for balancing the inner and outer electromagnetic containment fields so that the solidifying hollow tubular product experiences no net radial force acting on it during solidification.

13. The continuous casting apparatus of claim 12 wherein the difference $\Delta f$ between the outer and inner electromagnetic field frequencies is greater than 100 hertz ($\Delta f > 100$ hertz).

14. The continuous casting apparatus of claim 13 wherein the operating frequencies of the outer and inner electromagnetic fields are chosen such that the fundamental frequencies of the outer and inner electromagnetic fields do not coincide with the principal harmonics thereof whereby the net force distribution produced in the tubular product being cast is the vector sum of the force distributions produced by the respective outer and inner containment fields.

15. The continuous casting apparatus of claim 14 wherein the vector sum of the electromagnetic containment force distributions is controlled by independently controlling any of the magnitude, frequency phase of the excitation currents supplied to produce the respective outer electromagnetic levitation and containment fields and the inner electromagnetic containment field.

16. The continuous casting apparatus according to claim 15 wherein the geometry and particularly the turns spacing between the coils of the respective outer levitation and containment field producing coil and the inner solenoid coil are adjusted to provide opposing containment field forces that are more precisely balanced to further assure that no net electromagnetically induced redial force is produced in the tubular liquid metal column during solidification.

17. The continuous casting apparatus of claim 15 in which the electromagnetic levitation field producing coil means includes a plurality of electromagnetic field producing coils for connection to successive phases of a polyphase electric current source for producing the upwardly traveling alternating electromagnetic levitation and containment fields.

18. The continuous casting apparatus of claim 17 including a reservoir chamber to contain a bath of liquid metal communicating with the lower end of the annular casting vessel, and means associated with the chamber to move the liquid metal upwardly into the casting vessel to a level above the lower end of the electromagnetic levitation and containment fields.

19. The continuous casting apparatus of claim 18 further including means for precooling the solidified hollow tubular metal product as it emerges from the upper portion of the annular casting vessel, means for rolling the product to a desired dimension and means for cooling the rolled product to an ambient temperature.

20. The continuous casting apparatus of claim 18 further including means for precooling the solidified hollow tubular metal product, and means for thereafter cooling the product to an ambient temperature.

* * * * *